United States Patent [19]

Yager

[11] Patent Number: 4,702,411

[45] Date of Patent: Oct. 27, 1987

[54] SIGNALING APPARATUS FOR MAILBOXES

[76] Inventor: James R. Yager, 31055 Lincoln Rd., Westlake, Ohio 44145

[21] Appl. No.: 902,792

[22] Filed: Sep. 2, 1986

[51] Int. Cl.[4] ..... B65D 91/00

[52] U.S. Cl. ..... 232/35

[58] Field of Search ..... 232/35, 37, 34, 17

[56] References Cited

U.S. PATENT DOCUMENTS

| | | | |
|---|---|---|---|
| 2,681,762 | 6/1954 | Long et al. | 232/35 |
| 2,693,314 | 11/1954 | Hunter | 232/35 |
| 4,138,056 | 2/1979 | Sherrill | 232/35 |
| 4,171,086 | 10/1979 | Hudson | 232/35 |
| 4,279,380 | 7/1981 | Husted | 232/35 |
| 4,524,905 | 6/1985 | Crist | 232/35 |
| 4,570,846 | 2/1986 | Morgrey | 232/35 |

*Primary Examiner*—Robert W. Gibson, Jr.

*Attorney, Agent, or Firm*—Renner, Kenner, Greive, Bobak & Taylor

[57] ABSTRACT

A signaling apparatus for use with a mailbox having a housing and a door which is movable between open and closed positions includes a mounting plate attachable to the exterior of the housing and a signaling member hingedly attached to the mounting plate and being movable between signaling and nonsignaling positions by a spring which interconnects the mounting plate and the signaling member. The signaling member is normally retained in nonsignaling condition by the door of the mailbox against the force of the spring and is automatically movable to its signaling position upon opening of the door.

6 Claims, 8 Drawing Figures

SIGNALING APPARATUS FOR MAILBOXES

FIELD OF THE INVENTION

This invention relates in general to signaling devices for rural type mailboxes and relates in particular to an inexpensive, easy to mount, signaling device which is normally held in a nonsignaling position by the door of the mailbox and which automatically moves to a signaling position when the door is opened.

BACKGROUND OF THE INVENTION

Many mailboxes, particularly those used in a rural or suburban setting, are mounted at a site remote from the house of the owner such as alongside a street or road.

It is desirable to be able to ascertain whether or not any mail has been deposited in the box without having to physically leave the house and proceed to the box to inspect it. The desirability of such a feature has been recognized for years and a number of different approaches to solving the problem have been attempted.

In some instances, springs have been utilized to activate the signal while, in other instances, counterweights provide the activating force.

Examples of various signaling devices of this general type found in the patent prior art can be seen in several U.S. patents such as Eging U.S. Pat. No. 3,102,684; Goodman U.S. Pat. No. 3,516,383; Harmon U.S. Pat. No. 3,815,811; Sherrill U.S. Pat. No. 4,138,056; Hudson U.S. Pat. No. 4,171,086 and Dion U.S. Pat. No. 4,473,182.

Generally, these devices require some modification to the mailbox itself and they also are somewhat restricted as to the precise point of mounting.

Thus, while the devices disclosed in the above-noted patents are presumably operative for the purposes for which they are designed none of them appears to present a simple, economical, easy to mount and compact signaling apparatus which is automatically activated by the opening of the door of the mailbox, is restricted in its mounting point only by its visibility from a remote location and requires virtually no physical alteration of the mailbox.

SUMMARY OF THE INVENTION

It has therefore been discovered that a signaling apparatus which is effective to alert the owner of the mailbox to the fact that mail has been deposited in the box can be produced with a relatively simple apparatus having the just noted advantages.

To that end, it has been discovered that two thin, substantially flat plates, one designated as a mounting plate and the other as a signaling plate, can be fabricated either of metal or plastic or some other suitable material, hinged together in end to end relationship and interconnected by a spring so that the spring would normally urge the one plate to a signaling position. That is to say that from a cocked, coplanar disposition, the plates would be moved into an L-shaped disposition for signaling purposes.

It has thus been found that it is possible to mount the first plate along the side of the mailbox with the second plate extending therefrom in end to end relationship while in cocked position and being held in that position by the overlapping flange of the door of the conventional mailbox so as to be normally retained in a nonsignaling condition. It has been discovered then that upon opening of the mailbox door the signaling plate or member will be released and move to the signaling position by the action of the spring.

Mounting of the apparatus on the box can be simply achieved by utilization of a double-faced pressure sensitive adhesive tape on the one member or alternatively, where the surface of the box is either too rough to accept the tape or will not accept the tape for other reasons, the mounting member can be secured by means of a single screw or bolt. In either case the signaling apparatus lies along the side of the box in such a mode as to present only an unobtrusive, minor projection from the mailbox, particularly in the nonsignaling position.

It has further been found that the signaling characteristics of the apparatus can be enhanced by coating the signaling member with some bright color so as to make it even more readily visible from a remote position.

Finally, it has been found that, with regard to certain mailboxes wherein the door closes inside the housing of the mailbox, a latch member can be provided on the door so as to hold the signaling member in the cocked or non-signaling position when the door is closed while still permitting automatic initiation of the signaling function upon opening of the door.

Accordingly production of an improved signaling apparatus for mailboxes of the type just described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
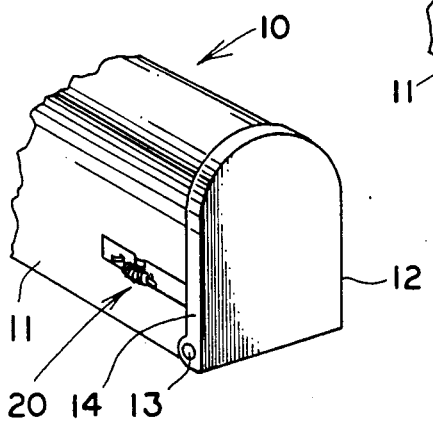
FIGS. 1 and 2 are partial perspective views showing the signaling apparatus mounted on a mailbox in both nonsignaling and conditions.
Figure 2:
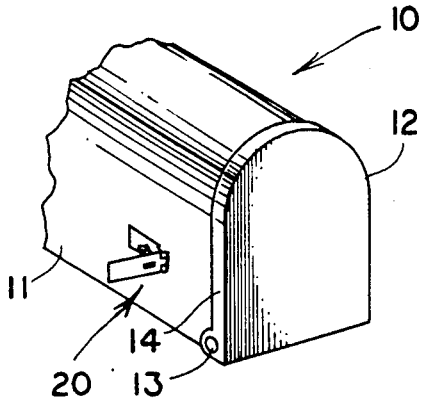

Referring first to FIGS. 1 and 2 of the drawings it will be seen that these figures illustrate the signaling apparatus mounted on a conventional mailbox in a partial perspective view with FIG. 1 illustrating the signaling apparatus in the nonsignaling or cocked position and with FIG. 2 illustrating the signaling apparatus in the signaling position.

Still referring to FIGS. 1 and 2 it will be noted that the conventional mailbox illustrated therein, generally indicated by the numeral 10, includes a housing 11 and a door 12. The door 12 is hingedly connected to the housing 11 as at 13 and includes a flange 14 which, in conventional mailbox construction, telescopes over the forward end of the housing 11 when in the closed position.

As can be seen in FIGS. 1 and 2, the signaling apparatus 20 is affixed along the side of the housing 11 although the precise location of the signaling device is not critical to its effective operation. The only requirement for the positioning of the apparatus 20 is that it be visible in the signaling position from the predetermined remote site.

Figure 3:
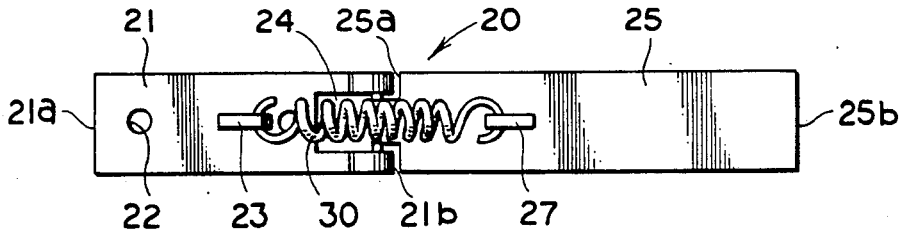
FIG. 3 is a top plan view of the signaling apparatus in the cocked position.
Figure 4:
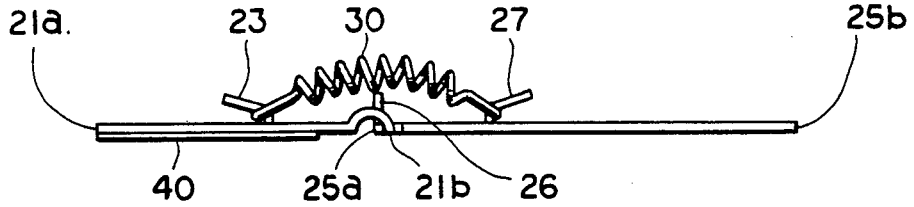
FIG. 4 is an elevational view of the signaling apparatus in a cocked position.

Referring next then to FIGS. 3 and 4 of the drawings for a more detailed consideration of the signaling apparatus 20, it will be seen that this apparatus generally comprises two relatively thin plates 21 and 25 which are flat elongate members and could be produced of either metal or plastic or a similar material.

The plate 21, which will be referred to herein as the mounting plate or mounting member, is an elongate piece having first and second ends 21*a* and 21*b*. As illustrated in the drawings an aperture 22 may be provided adjacent first end 21*a* so that, if necessary, a nut and bolt arrangement can be provided for mounting to housing 11 although in most instances it is believed that there is a more desirable mounting approach which will be described below.

Struck from or rising from the one face of the mounting member plate 21 is a hook 23 which is designed to engage one end of the spring 30.

The second end 21*b* of plate 21 terminates in a hinge seat as can be seen more clearly in FIG. 4 of the drawings and also has a central cutout area 24 extending longitudinally inwardly for reception of a portion of the second plate 25 as will be described.

Still referring to FIGS. 3 and 4 of the drawings and referring specifically to the signaling plate or member 25 which consists of an elongate plate similar to that of the mounting member 21, it will be seen that this plate has opposed first and second ends 25*a* and 25*b* with the end 25*a* terminating in a central upstanding projection 26 and laterally extending hinge pins. Also struck from or projecting above the one face of the plate 25 is a hook 27 similar to hook 23 intended to engage the opposed end of the spring 30.

In that regard it will be seen from FIGS. 3 and 4 that the spring 30 is a coil spring of a common type and has its opposed ends engaged with the hooks 23 and 27. In that regard, it will be noted that the invention is not intended to be limited to the employment of any particular style of spring.

Still referring to FIG. 4 it will be noted that a double-faced, pressure sensitive adhesive tape 40 is mounted on a second face of the plate 21 which facilitates mounting of that plate on the side of the mailbox housing 11 as shown in FIGS. 1 and 2 of the drawings. This type of mounting eliminates the need for any tools and makes it possible to mount the signaling apparatus in a matter of seconds without any modification of the mailbox.

It will also be noted from FIGS. 1 and 2 of the drawings that the projecting second end 25*b* of the plate 25 will fit beneath the flange 14 of the door 12 so that, as illustrated in FIG. 1 of the drawings, the signaling apparatus will normally be held in the cocked or nonsignaling position. It will also lie flush along the outer surface of housing 11 thereby avoiding inadvertent damage thereto.

Figure 5:
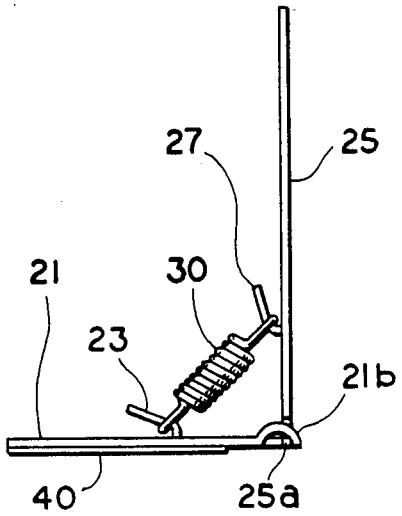
FIG. 5 is an elevational view of the signaling apparatus in the signaling position.

Once the door 12, however, has been swung open the spring 30 will bias the plate 25 to the signaling position as shown in FIGS. 2 and 5 of the drawings. In that regard, of course, the plate 25 will pivot about the hinge connection which is readily apparent between the second end 21*b* of the plate 21 and the first end 25*a* of the plate 25. When this occurs, projection 26 will be received in a cutout area 24 of the plate 21 and engage the side of housing 11 to limit pivotal movement about the point of interconnection between the two plates. Effectively the two plates will thus assume an L-shaped configuration at this time.

Assuming the apparatus has been properly positioned in a clear line of sight to the house the signaling member or plate 25 will then be clearly visible.

It will also be understood that even more effective signaling can be achieved if the plate 25 is painted or otherwise coated with some bright color which makes it even more readily visible from the remote location.

Figure 6:
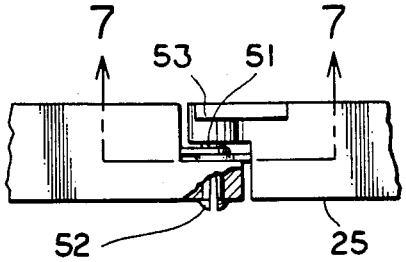
FIG. 6 is a partial plan view of a modified form of the invention.
Figure 7:
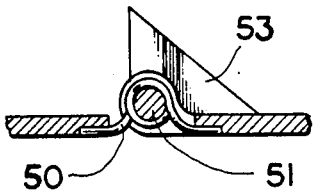
FIG. 7 is an elevational view taken along the line 7—7 of FIG. 6.

In the event the plates 21 and 25 are molded of plastic or similar material an alternative type of spring means may be employed as can be seen in FIGS. 6 and 7 wherein a torsion spring 50 is mounted about an integral pin 51 molded into plate 25 and which engages a split, tubular member 52 so that the pin can be snapped into member 52 for assembly. This arrangement provides a spring which has adequate strength to pull the signaling member into the signaling position although it should be understood that the invention is not intended to be limited to a particular form of spring as previously noted. It will also be noted that, in this form of the invention an upstanding projection 53 may be provided on plate 25 to limit pivotal movement.

In any event, it will also be noted that this structure is such that it is very easy to mount and very inexpensive to produce. Additionally, it is relatively compact and does not present any significant projections from the plane of the mailbox itself thereby enhancing its durability and making it much less susceptible to inadvertent damage as is the case with much of the prior art referred to above.

Some mailboxes are constructed somewhat differently from the exemplary mailbox illustrated in FIGS. 1 and 2 of the drawings in that, instead of having a flange 14 which telescopes about the outside of the housing 11, the door recesses inside of the housing when closed.

Figure 8:
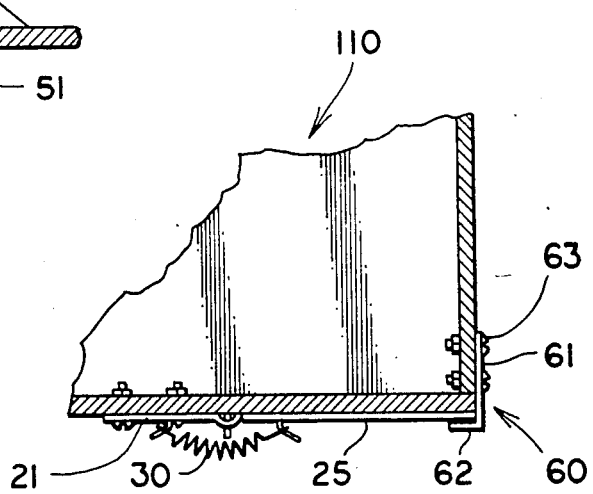
FIG. 8 is a partial elevational view showing a modified form of the invention.

Referring to FIG. 8, a mailbox such as this is shown in a fragmentary view and indicated by the numeral 110. In this instance a latching means 60 would be required to complete the signaling apparatus. This latching means 60 is secured to the door of the box by screws 63 or could be, if desired, secured by adhesive means such as a tape similar to the tape 40 illustrated in FIG. 4.

The latching means 60 is an L-shaped member having a first leg 61 secured to the door and a second leg 62 for engagement with the signaling apparatus.

In this form of the invention the signaling apparatus itself is identical in structure and operation except that in operation the signaling member or plate 25 is held in the cocked or nonsignaling position by the leg 62 of the latching member 60.

Operation is basically similar to that described in connection with the form of the invention illustrated in FIGS. 1 through 7, in that, when the door is opened the leg 62 uncovers the second end 25*b* of the signaling member 25 and permits the spring 30 to pull it to the signaling position.

While a full and complete description of the invention has been set forth in accordance with the dictates of the patent statutes it should be understood that modifications can be resorted to without departing from the spirit of or the scope of the appended claims.

Thus, the plates 21 and 25 can be constructed of any reasonably rigid, durable material and, within certain reasonable parameters dictated by the size of the mailbox, could be of any desired size.

It will also be apparent that this signaling apparatus has equal advantages as original equipment for new mailboxes or as a retrofitting package for existing ones.

What is claimed is:

1. A signaling apparatus for use with a mailbox having a housing and a door movable between open and closed positions, comprising:

(A) a mounting member attachable to the exterior of the housing and including a first elongate plate having first and second ends and attachment means carried by said first elongate plate;

(B) a signaling member including a second elongate plate having first and second elongate plate having first and second ends; said second end of said first elongate plate being hingedly engaged by and normally in juxtaposition in the same plane as said first end of said second elongate plate;

(C) spring means interconnecting said mounting member and said signaling member;

(D) said signaling member being normally retained in nonsignaling condition by the door against the force of said spring means and being movable to signaling position by said spring means upon opening of the door; and (E) said signaling position being approximately perpendicular to the plane of the housing to which said mounting member is attached.

2. The apparatus of claim 1 wherein said attachment means include adhesive means.

3. The apparatus of claim 1 wherein said attachment means include pressure sensitive tape disposed on one face of said first elongate plate.

4. The apparatus of claim 1 wherein said second end of said second elongate plate is engageable by the door when the door is in the closed position.

5. The apparatus of claim 1 wherein latch means are attachable to said door; said latch means are engageable with said signaling means when the door is in closed position.

6. The apparatus of claim 1 wherein limiting means are carried by said first end of said second elongate plate whereby the extent of movement from nonsignaling to signaling positions is controlled; said limiting means being integrally formed from and perpendicular to said second elongate plate.

* * * * *